United States Patent [19]

Bassing

[11] Patent Number: 4,934,415

[45] Date of Patent: Jun. 19, 1990

[54] TUBULAR COP EXCHANGE ARRANGEMENT FOR LOOMS

[75] Inventor: Friedrich W. Bassing, Emsdetten, Fed. Rep. of Germany

[73] Assignee: Jürgens Maschinenbau GmbH & Co. KG, Emsdetten, Fed. Rep. of Germany

[21] Appl. No.: 255,647

[22] Filed: Oct. 11, 1988

[30] Foreign Application Priority Data

Oct. 8, 1987 [EP] European Pat. Off. ..... 87114719

[51] Int. Cl.[5] ..... D03D 45/20

[52] U.S. Cl. ..... 139/245; 139/207; 139/247; 139/263

[58] Field of Search ..... 139/247, 246, 251, 241, 139/245, 207, 209, 225, 256 A, 260, 263, 232 C

[56] References Cited

U.S. PATENT DOCUMENTS

| | | | |
|---|---|---|---|
| 2,921,610 | 1/1960 | Banks et al. | 139/245 |
| 2,957,497 | 10/1960 | Baumann | 139/245 |
| 4,063,635 | 12/1977 | Heckel | 139/245 X |

FOREIGN PATENT DOCUMENTS

| | | |
|---|---|---|
| 1535424 | 7/1970 | Fed. Rep. of Germany . |
| 1535676 | 8/1971 | Fed. Rep. of Germany . |

*Primary Examiner*—Andrew M. Falik
*Attorney, Agent, or Firm*—Michael J. Striker

[57] ABSTRACT

A tubular cop exchange arrangement comprises a cop magazine, a cop pressing device for pressing a cop from the magazine into a trough chamber of a shuttle, a cutting device for separating a weft thread from the ejected remaining portion of the cop and a control device. The shuttle has a clamping device provided near one end of a trough chamber for fixing the holding pin of a tubular cop, the shuttle having a thread brake and a thread inserting slot extending from another end of the trough chamber substantially rectilinearly. The cop ejecting device has a cop ejecting plunger which is upwardly extendable in a shuttle cop exchange position in a direction toward the holding pin clamped in the clamping device. The cop pressing device has a cop pressing plunger which is extendable in the cop exchange position downwardly against a cop located in the cop outlet opening of the cop magazine. In the cop exchange position the thread inserting device is positioned over the thread inserting slot and is lowerable simultaneously with the cop pressing plunger for insertion of a weft thread into the thread inserting slot. The thread inserting device is provided with at least one thread gripper, advantageously two thread grippers.

23 Claims, 6 Drawing Sheets

TUBULAR COP EXCHANGE ARRANGEMENT FOR LOOMS

BACKGROUND OF THE INVENTION

The present invention relates to a tubular cop exchange arrangement for a loom. More particularly, it relates to a tubular cop exchange arrangement for a loom comprising a cop magazine arranged above a web lay and having a cop outlet opening which in a cop exchange position is located closely above an open trough chamber of a shuttle, a cop ejecting device for removing a remaining portion of the cop from the shuttle, a cop pressing device for pressing a new tubular cop from the cop magazine into the trough chamber of the shuttle, a cutting device for separating the weft thread from the ejected remaining portion of the cop and control devices for actuating the above mentioned devices in a respective time sequence.

Tubular cop exchange arrangements of the above mentioned general type are known in the art. One of such arrangements is disclosed, for example, in the German document DE No. 1,535,676. This exchange arrangement is designed for feeding the tubular cop which is completely composed of a cop yarn by a cop pressing device into the trough chamber of a shuttle provided with brush strips or similar holding devices which cooperate with the outer surface of the tubular cop. The ejecting of the remaining portion of the cop from the shuttle is performed by an ejecting arm which is pivotally mounted above the shuttle box. The ejecting arm tears off the remaining portion of the cop which is held in the shuttle end from the trough chamber with its hook-shaped end, and throws the same into a catching basket which is arranged near the loom. In this known structure because of unavoidable tolerances in the outer diameter and in the compressibility and the surface roughness of the used tubular cop, due to its pressing into trough chamber of the shuttle, an exactly reproducible seat is not achieved, and a sufficiently reliable prevention of axial and transverse displacements of the tubular cop in a reciprocating shuttle is not obtained as well. Because of these difficulties, the tubular cop have been used substantially for production of less demanding textile products such as floor cloth, mats or coarse wool covers. For processing synthetic yarn the tubular cops have practically scarcely been used.

The German reference DE No. 1,535,424 discloses a weft coil exchange arrangement for looms in which a weft coil is ejected from the coil magazine by means of a striking hammer with a holding pin in an automatic clamp provided in a web shuttle. Such weft coils are usable only in a limited strength because of weaving requirements, and due to their coil core can carry only relatively small weft thread quantities compared with the tubular cops. Since, especially in full width looms with working width up to 30 m, the weft thread lengths in a shuttle are consumed in a very short time, the exchange points in fabric lie so close to each other that it is required to distribute the points of overlapping of the weft thread ends of the old weft coil and the weft thread starts of the new weft coil over the fabric width. For this purpose, to provide the step identified as a weft application, the loom must be stopped and a part of the introduced weft thread must be pulled out through the upper shed and cut off, and then the filled shuttle must be displaced by approximately 1–2 cm through the upper shed and manually transported into the shuttle box, so that the weft thread ends are placed together with slight overlap. Since this process repeats every 1–2 minutes, a considerable strain on the worker occurs and a significant stoppage time of the loom takes place. The loom can operate only with an efficiency 50–60%.

Because of the great weft thread length of tubular cops, it has been recognized that for producing endlessly woven paper machine fabrics tubular cops have to be used for increasing the running time of the shuttles. However, this has not been implemented since undesirable displacements and premature falling out of the tubular cop in the shuttles which are reciprocable with high speed could not be reliably prevented, and withdrawal of the weft thread from the inner cone of the tubular cop caused uncontrollable balloon formation in the shuttles. Accordingly, it was not possible to achieve a sufficiently reliable automatic exchange of the tubular cop in the shuttles.

SUMMARY OF THE INVENTION

Accordingly, it is an object of the present invention to provide a tubular cop exchange arrangement for looms of the above mentioned general type, which avoids the disadvantages of the prior art.

More particularly, it is an object of the present invention to provide a tubular cop exchange arrangement for looms, which permits a reliable automatic cop exchange in a simple manner, and a continuous disturbance free tubular cop weaving with high efficiency of the loom.

In keeping with these objects and with others which will become apparent hereinafter, the tubular cop exchange arrangement comprising a cop magazine formed for uni-directional receipt of a tubular cop which has a cop body with one cop end formed for withdrawal and another cop end provided with an attachment part having a holding pin coaxially extending beyond the body. The cop exchange arrangement further comprises a clamping device associated with the shuttle movable to one end of a trough chamber of the shuttle for fixing the holding pin of a tubular cop and a thread insertion slot in the other end of the trough chamber as well as a thread brake. The cop exchange arrangement also has a cop exchange plunger upwardly extendable through a lower opening of a web lay against the holding pin clamped in a clamping device and a cop pressing device with a cop pressing plunger which in a cop exchange position of the shuttle moves downwardly against a tubular cop which is pressed at the cop outlet opening of the cop magazine for pressing the holding pin of this tubular cop in the clamping device of the shuttle. In the cop exchange arrangement of the shuttle a thread inserting device is lowerable over the thread inserting slot simultaneously with the cop pressing plunger and has at least one thread gripper which inserts the thread passing through a thread slot of the cop magazine into the thread inserting slot and in some cases into the thread brake of the shuttle.

The cop magazine for the tubular cop which is described in the parallel patent application of the inventor, Ser. No. 255,646, pending, has the one end of the cop body designed for withdrawal and an attachment part with a coaxially extending holding pin at the other end of the cop body. A clamping arrangement is arranged in the shuttle for directional fixation of the holding pin of the tubular cop and the thread inserting device is lowerable simultaneously with the cop pressing plunger. Thus, very reliable bringing and holding of a new tubular cop and the associated weft thread in the shuttle and the release of the residual portion of the old cop by the cop ejecting plunger is achieved. Since all working steps connected with the cop exchange are performed by an electronic control automatically, a substantially increased efficiency of the loom is achieved in multi-shuttle full width looms with both sides drop box exchange and a four color tubular cop magazine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is a side view of a cop exchange arrangement with shuttle striking device.

DETAILED DESCRIPTION OF THE PREFERRED EMBODIMENTS

Figure 1:
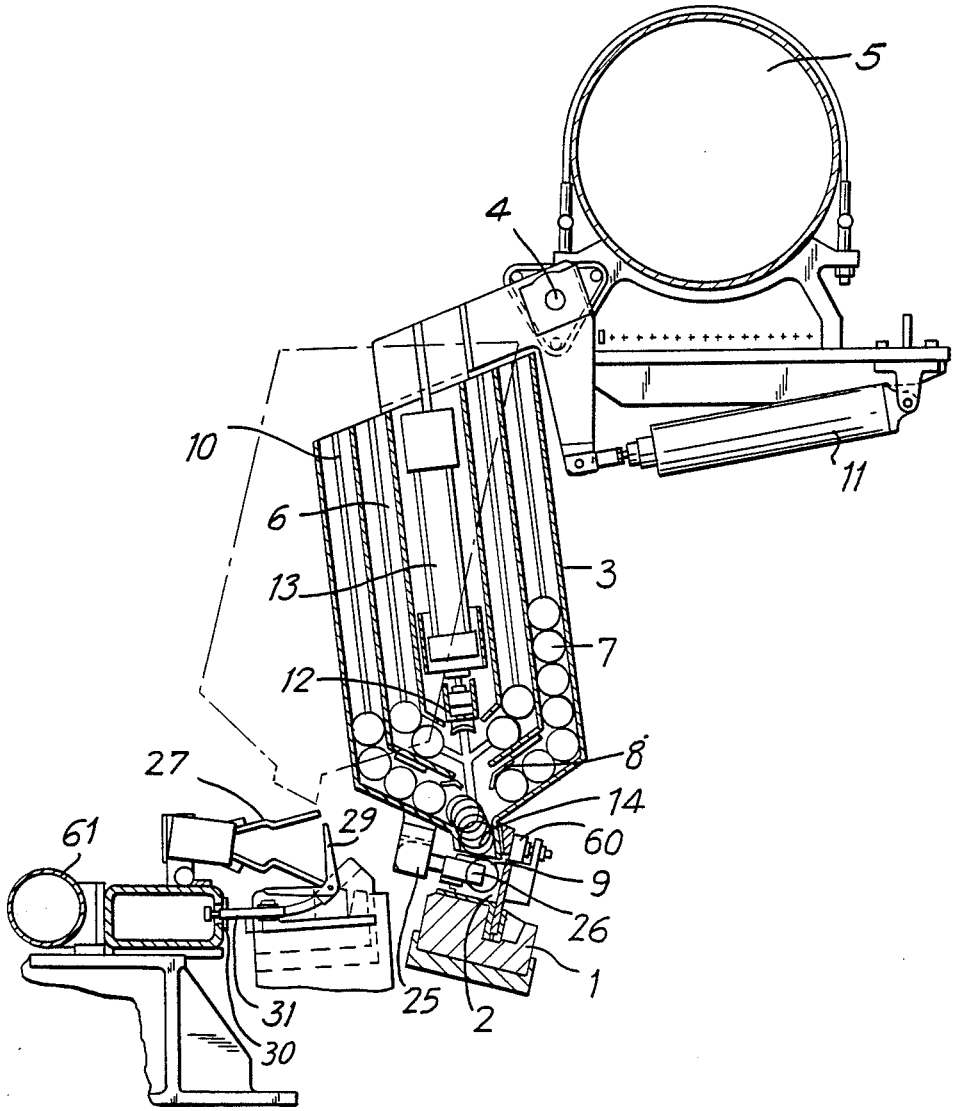
FIG. 1 is a schematic partial section through a web lay, a cop magazine and associated devices of a loom.

An exchange arrangement for tubular cops to be used for a full-width loom which operates with several shuttles and drop box exchange is shown in FIGS. 1–5. The arrangement has a cop magazine 3 located above a web lay 1. The cop magazine 3 is turnable by a pressure medium cylinder-piston unit 11 and an angular arm turnably connected with it about a horizontal turning axle 4 which is arranged on an upper traverse 5 of the loom, between a cop pressing-in position shown in solid lines and a rest position shown in broken lines in FIG. 1.

Figure 7:
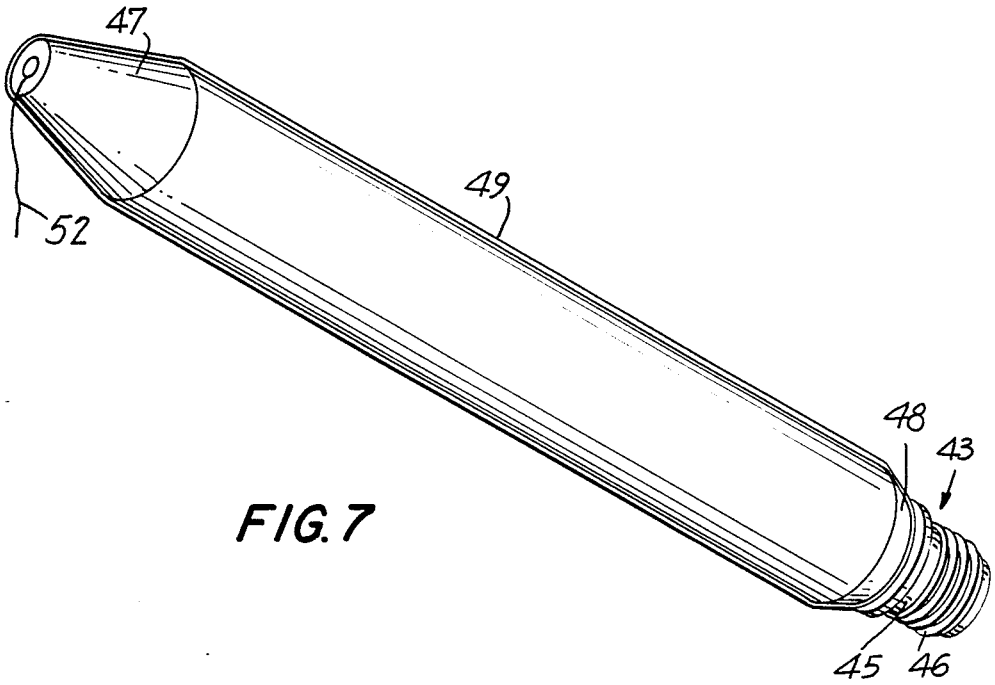
FIG. 7 is a schematic perspective view of a tubular cop to be used in the inventive tubular cop exchange arrangement.

The cop magazine is provided on its upper part with four parallel storage shafts 6 for uniformly oriented receipt of a plurality of tubular cops 7 of the type shown in FIG. 7. Each of the storage shafts 6 has a thread slot 10 which is arranged in an end wall facing away from a fabric edge 62. Thread ends of the tubular cop 7 are respectively guided through the thread slot of their storage shaft 6 to a not shown suction pipe. The storage shafts 6 are angled inwardly in their lower portions and each provided with a movable a blocking flap 8. The blocking flap 8 moves between a blocking position as well an open position for passing one tubular cop 7.

A central pressing chamber 14 lies between the outlet ends of the storage shafts 6 and their blocking flaps 8 and has a cop outlet opening at the lower side of the cop magazine. A cop pressing device is provided in the cop magazine 3 between both inner storage shafts 6. It has a pressure medium-actuated pressing cylinder 13 and a cop pressing plunger 12 which is displaceable between a rest position shown in FIG. 1 and a downwardly extended pressing position. It presses a tubular cop 7, which had been brought through the open blocking flap 8 into the pressing chamber 14 and lies in a cop outlet opening, into a trough chamber 37 of the shuttle 2 which is closely arranged underneath in the cop exchange device.

Figure 2:
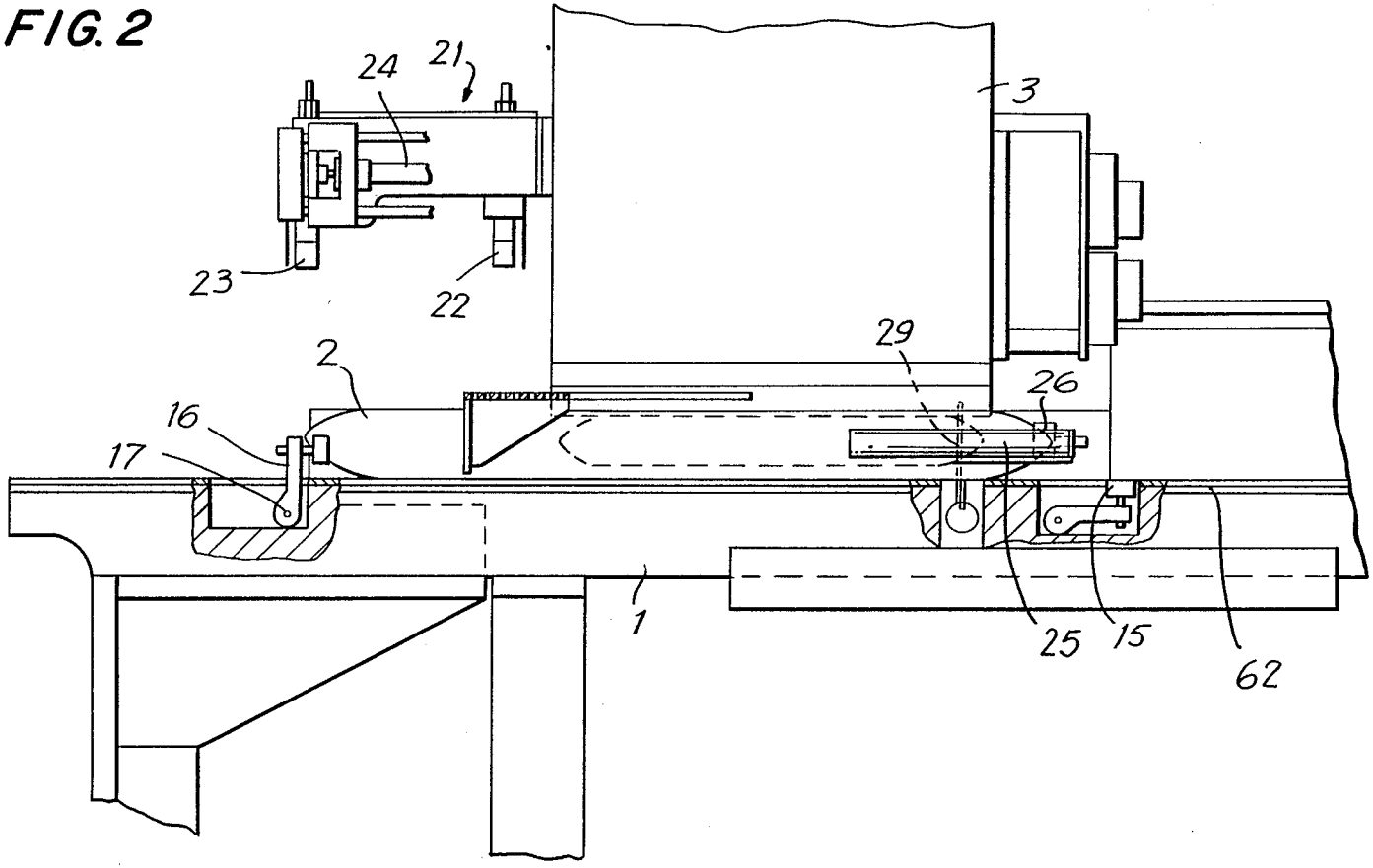
FIG. 2 is a partially broken side view of the weft lay, the cop magazine and a shuttle held in a cop exchange position of the cop exchange arrangement in accordance with the present invention.
Figure 3:
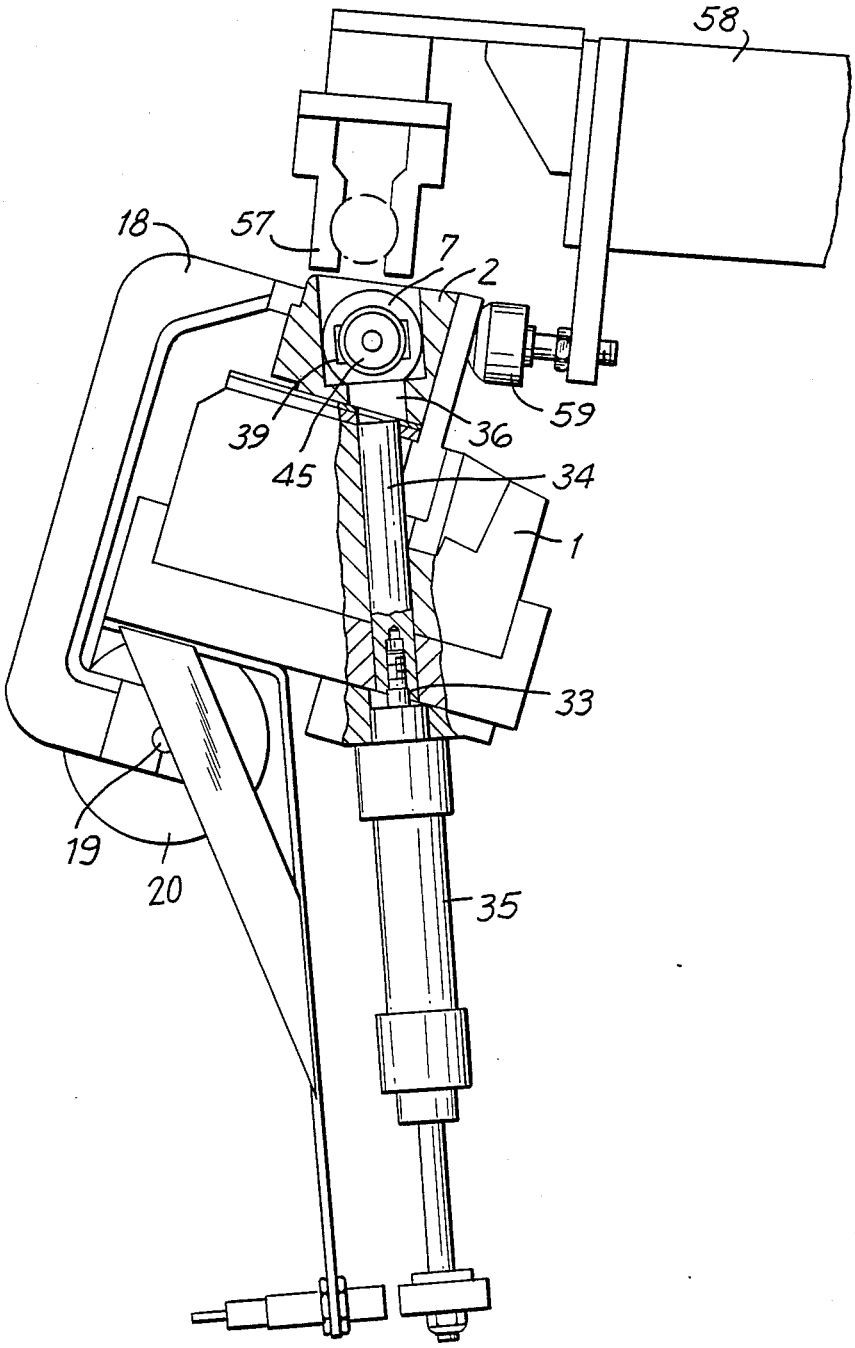
FIG. 3 is a partially sectioned side view of a cop ejecting device of the cop exchange arrangement of the present invention.

Since the cop exchange in the illustrated loom with drop box exchange cannot be performed in the drop box, the shuttle 2 is moved from the not shown drop box by means of respective controlled striking cylinder-piston units with a small ejection speed to the cop exchange position shown in FIG. 2. In this position it is held by a positioning element 15 arranged in an upwardly turnable manner in the web lay 1 and shown in FIG. 2 in a downwardly turned rest position. It is fixed by a positioning element 16 which is upwardly turnable about a turning axle 17 to the other shuttle end in the web lay 1. A holding down member 18 is further arranged on the web lay 1 turnably about a horizontal turning axle 19 as shown in FIG. 3. It is movable by a pressure medium cylinder-piston unit 20 to the position shown in FIG. 3 in which it is laterally pressed against the shuttle.

The shuttle striking device 64 for the cop exchange arrangement 63 is shown in FIG. 8.

Figure 6:
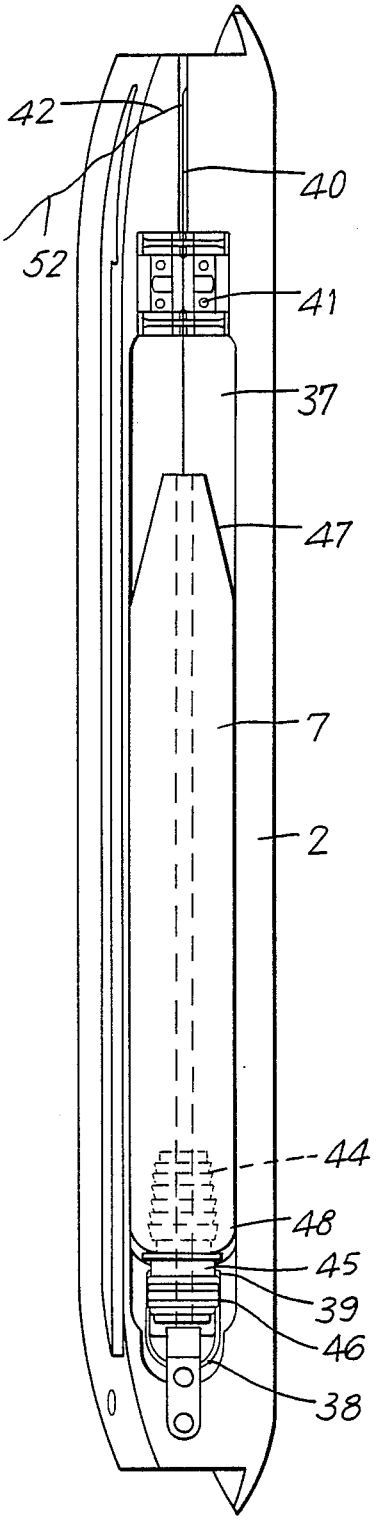
FIG. 6 is a schematic view of an associated shuttle with an inserted tubular cop in the tubular cop exchange arrangement in accordance with the present invention.

The shuttle 2 which is shown in FIG. 6 has an upwardly open trough chamber 37 and a clamping device 38 which is arranged near one end of the trough chamber and provided with two springy clamping jaws 39 located opposite to one another and associated with side walls of the shuttle 2 for exchangeable pressing-in of a holding pin 45 of a tubular cop 7 shown in FIG. 7. A thread inserting slot 40 is provided on the other end of the shuttle 2 and extends rectilinearly from the trough chamber 37 in its longitudinal direction to the shuttle end. The thread inserting slot 40 has a depth extending over the central axis of the shuttle. A laterally branching conventional threading device 42 is connected with the thread inserting slot 40. A thread brake 41 is arranged at the end of the trough chamber 37 which is opposite to the clamping device 38, in alignment with the thread inserting slot 40. The thread brake 41 is arranged in a shuttle which is described in detail in the parallel patent application of the applicant, Ser. No. 255,648.

The tubular cop 7 shown in FIGS. 6 and 7 has a conical cop end 47 which forms an outer withdrawal and another cop end 48 in which an attachment part 43 fixedly holding the cop yarn is provided. The attachment part 43 has a yarn-enveloping attachment cone 44 with oppositely conically inclined ring steps, and a coaxial outwardly projecting holding pin 45 which in the shown embodiment is provided with four slotted arresting rings 46 clamped in the ring grooves of the holding pin 45. The tubular cop 7 is tightly enclosed by a pressed-on (shrunk-on) casing 49 of synthetic plastic shrinking foil which extends at least to the end of the yarn coil which surrounds the attachment part 43. For increasing the stiffness, a reinforcing strip with embedded reinforcing threads is glued on the casing 49 and extends in an axial direction. A thread 52 which is pulled from the conical outer surface of the cop end 47 through a central opening of the casing 49 is inserted during the cop exchange into the thread inserting slot 40 and a thread brake 41.

A thread inserting device 21 which is connected with the cop pressing plunger 12 for joint lowering movement is arranged at the side of the cop magazine 3 which is opposite to the fabric edge 62. It has a thread gripper 22 which is located tightly on the cop magazine end wall containing the thread slot 10. It also has a second thread gripper 23 which is horizontally displaceable relative to the first thread gripper 22 in a limited degree. The thread gripper 23 is displaceable in direction to the thread gripper 22 by a pressure medium-actuated thread clamping cylinder-piston unit 24, so that the thread 52 of the tubular cop pressed in the shuttle 2 is rectilinearly clamped by both thread grippers 22 and 23.

The thread guiding device 21 with the tightly clamped thread 52 in the thread grippers 22 and 23 is lowerable so that the thread gripper 22 is lowered and the thread gripper 23 moves down at the outer side of the shuttle and so far that the thread which is rectilinearly spanned between the thread grippers 22 and 23 is inserted into the thread inserting slot 40 and the slot of the thread braker 41 which is in alignment with the slot 40.

Figure 5:
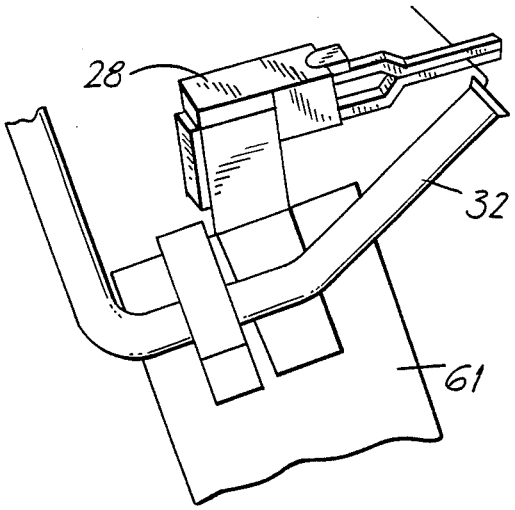
FIG. 5 is a schematic view of a weft thread gripper with a thread suction pipe of the tubular cop exchange arrangement of the present invention.

As can be seen from FIG. 1, a first weft (filling) thread gripper 27 and a second weft thread gripper 28 shown in FIG. 5 are arranged on a shaped pipe connected to a forebeam 61, between fabric edge 62 and the cop magazine 3. The second weft thread gripper 28 is not shown in FIG. 1 and is mounted behind the cop magazine 3 as seen in direction from the fabric edge 62. The thread shear 29 is mounted to the web lay 1. The shear plunger 31 is projecting towards the forebeam 61, which has a hole in order not to interfere with the shear plunger during the to and fro movement of the web lay. To cut the weft thread an abutment plate 30 is actuated by an unshown drive closing the hole in the forebeam. The shear plunger 31 abuts on the thread shear 29 during the next movement and actuates it (see also page 18). The cut off remaining portion of the weft thread is aspirated after the release through the thread gripper 28 via a thread suction pipe located near it.

For withdrawing the continuously running remaining portion of the cop from the shuttle 2, a cop ejecting device is provided. It has a cop ejecting plunger 34 which is displaceably guided in an ejecting opening 33 of the web lay 1, and a pressure medium-actuated ejecting cylinder-piston unit 35. It extends the cop ejecting plunger 34 when the shuttle 2 is fixed in the cop exchange device, through a throughgoing opening provided at the lower end of the shuttle 2 against the holding pin 45 of the residual portion of the cop, which is clamped in the springy clamping jaws 39 of the clamping device 38. Thereby the holding pin 45 is pushed out upwardly from the clamping jaws 39.

A cop residue discharge device 56 is provided for discharging the remaining portion of the cop. It is movable by means of a pressure medium-actuated adjusting cylinder-piston unit 58 between the receiving position shown in FIG. 3 and a release position. The holding pin 45 of the remaining portion of the cop which is pushed out by the cop ejecting plunger 34 from the clamping jaws 39 of the shuttle 2 runs to a cop residue gripper 57 which in the receiving position is arranged above the cop ejecting plunger 34, and then moves with the gripper by actuation of the adjusting cylinder-piston unit 58 to the release position so that then it can fall in an accumulating container. For accurate orientation of the cop residue gripper 57 relative to the shuttle 2, a positioning abutment 59 is used. In the receiving position it abuts against an upwardly projecting guiding web of the web lay 1.

A thread shear 53 which is actuated by a pressure medium cylinder-piston unit 54 is connected turnably about a horizontal turning axle 55 with the cop residue discharge device 56. A thread shear 53 is turned in the portion of the trough chamber 37 between the thread brake 41 and the end of the continuously emptying casing 49 for cutting off the remaining thread which runs from the remaining portion of the cop through the thread brake 41.

Then the new tubular cop 7 is pressed by the downwardly movable cop pressing plunger 12 into the empty trough chamber 37 of the shuttle 2, so that the arresting ring 46 of its holding pin 45 snaps in the springy clamping jaws 39 of clamping device 38. Simultaneously with the cop pressing plunger 12, the thread guiding device 21 with the tightly clamped thread 52 in the thread grippers 22 and 23 after actuation of the thread clamping cylinder-piston unit 24, is lowered so that the thread gripper 22 sinks between the thread brake 41 and the cop end 47 in the trough chamber 37 while the thread gripper 23 moves downwardly at the outer side of the shuttle and so far that the thread which is rectilinearly spanned between the thread grippers 22 and 23 is inserted into the thread inserting slot 40 and the slot of the thread brake 41 which is in alignment with the slot 40.

As previously mentioned in this connection the thread projecting out of the thread slot 10 of the storage shaft is tightened by an unshown suction pipe. The thread gripper 22 is mounted to the cop magazine near the thread slot 10, as well as gripper 23 which is displacable by cylinder-piston-unit 24. The thread brake which is disclosed in the aforementioned parallel patent application of the applicant is designed so that the inserted thread cannot be pulled upwardly from it. In this manner simultaneously with the pressing of the new tubular cop 7 in, a reliable insertion of the thread to the thread brake 41 and the thread inserting slot 40 is achieved. The thread which is guided in the thread inserting slot 40 lies during subsequent sequent shuttle striking operation during the reverse of the normal shuttle movement direction in the threading device 42.

After finishing the cop exchange, the shuttle 2 is moved back into the drop box by means of a pressure medium-actuated return cylinder-piston unit 25 which is arranged horizontally at the lower side of the cop magazine 3, and a return element 26 which is displaceable by the return cylinder-piston unit and cooperates with the shuttle 2.

For operating the above described tubular cop exchange device for a multi-shuttle full-width loom with a drop box exchange and four color tubular cop processing, the individual storage shafts 6 of the cop magazine 3 are first loaded with the tubular cops 7 of respective different types which are produced for obtaining an optimal weft thread capacity in narrow tolerances for the cop diameter, the cop length and the accurately dimensioned wound weft thread length. An electronic counter is associated with each storage shaft 6 and cooperates with a predetermined box cell of the drop box exchange via the loom control or control device. The control device is a computer which receives the counter signal as an input and processes according to the software output signals used to control the machine. Then the possible number of the weft supply which is obtained by calculations with consideration of the weft thread length wound on the tubular cop 7 and the fabric width is adjusted on the electronic counter so that the counter automatically activates a tubular cop exchange after counting the adjusted number of the weft supply, when the shuttle flies in the shown embodiment from the right to the left in its box cell. During subsequent loading process the weft thread which is introduced from the shuttle 2 into the web shed is engaged by the weft thread grippers 27 and 28 on the forebeam 61 and cut during loading abutment by means of the weft thread shear 29. The start of the cop exchange proper is held off until the shuttle 2 with the empty residual portion of the cop is moved downwardly to the loading path and stands ready for the shuttle strike from the left to the right. In this position the shuttle strike is set up by the control device and the web lay 1 is stopped in its rear loading position with the fully open weft shed. After turning upwardly the positioning element 15, the shuttle 2 is moved by means of a not shown striking cylinder-piston unit with a controlled and slow speed to the cop exchange position shown in FIG. 2 and axially fixed in this position by turning upwardly from the other positioning element 16. Simultaneously, the holding down element 18 is turned by actuation of the turning cylinder-piston unit 20 about the turning axle 19 to the position shown in FIG. 3, so that the shuttle 2 is fixed reliably in an optimal position for the cop exchange.

Figure 4:
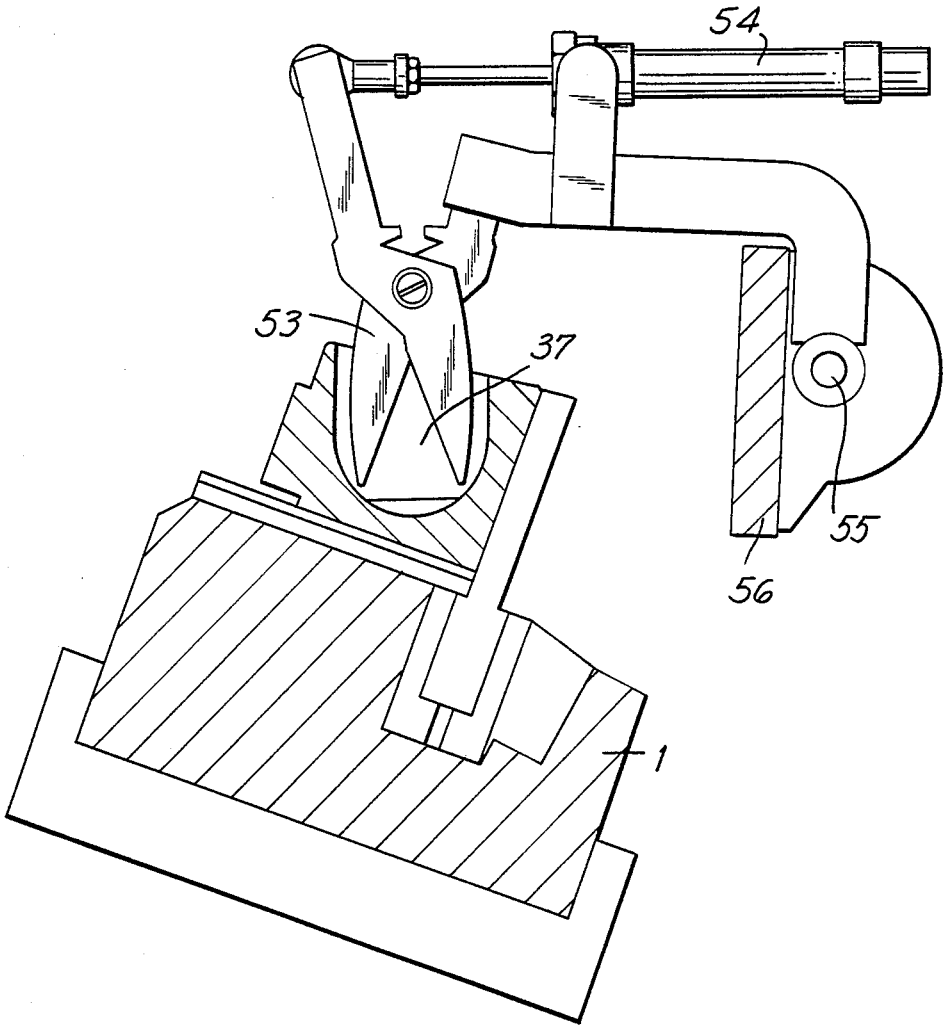
FIG. 4 is a partially sectioned view of a cutting device which is lowered into the shuttle of the inventive tubular cop exchange device.

In this position the cop residue discharge device 56 is moved by means of the adjusting cylinder-piston unit 58 against an abutment 59 to the receiving position shown in FIG. 3, and the thread shear 53 is turned to the position shown in FIG. 4 into the trough chamber 37 of the shuttle 2. By actuation of the ejecting cylinder-piston unit 35, the cop ejecting plunger 34 is extended through the throughgoing opening 36 against the holding pin 45 of the remaining portion of the cop which is clamped in the springy clamping jaws 39 of the clamping device 38. It transfers the same to the cop residue gripper 57 located immediately above it. In the upper end position of the cop ejecting plunger 34, the thread shear 53 cuts off the remaining thread from the remaining portion of the cop. The thread shear 53 and the cop residue discharge device 56 are then moved to their initial position, and the received remaining portion of the cop is removed from of the cop residue gripper 57 by an unshown drive.

By pressing-in of a new tubular cop 7, the cop magazine 3 is turned about the turning axle 4 against an abutment 60 to the position shown in FIG. 1. In this position its cop outlet opening 9 lies exactly oriented over the upwardly open trough chamber 37 of the shuttle 2. A tubular cop is moved into the pressing chamber 14 from the storage shaft 6 for loading the shuttle 2, and then by actuating the pressing cylinder-piston unit 13 it is passed by the cop pressing plunger 12 through the cop outlet opening 9 into the trough chamber 37 of the shuttle 2, so that the arresting ring 46 snaps its holding pin 45 between the springy clamping jaws 39 of the clamping device 38, and the casing 49 which narrowly surrounds the cop yarn coil is held without contact with holding device in an exactly oriented free condition in the trough chamber 37. The thread 52 which is guided through the thread slot 10 of the respective storage shaft 6 to a not shown suction pipe, is simultaneously engaged by the thread grippers 22 and 23 of the thread inserting device 21. By actuation of the thread clamping cylinder-piston unit 24 with displacement of the thread grippers 23 it is rectilinearly clamped, and then inserted automatically into the thread inserting slot 40 and the thread brake 41 by the thread gripper 23 which lowers into the trough chamber 37 between the thread brake 41 and the end of the casing 49, and the thread gripper 23 which lowers outside the shuttle end.

When the cop pressing plunger 12 and the thread inserting device 21 move back upwardly to their rest position, the thread gripper 20 releases the cop thread. Either in this position or before the pressing-in of the tubular cop, the positioning elements 15 and 16 and the holding back member 18 are moved back to their position in which they release the shuttle 2.

After finishing the cop exchange, the shuttle 2 is pushed back into the box cell by the return cylinder-piston unit 25 mounted on the cop magazine 3 and by the return element 26, and positioned there by means of an auxiliary brake. The cop magazine 3 and the return cylinder-piston unit 25 turn back to their rest position shown in broken lines.

An individual strike of the shuttle 2 from the left to the right is first performed, and the electronic counter is automatically set back to zero. After elapsing of the shuttle flying time, the loom switches automatically from the cop exchange mode to the normal operation mode. During the next stroke of the web lay 1 the cutting of the new weft thread is performed by the weft thread shear 29. The weft thread grippers 27 and 28 and the thread gripper 23 release the thread which then is aspirated by the thread suction pipe 32.

A measuring device is provided for the residual quantity of weft thread located on the tubular cop. It consists of a counter, which counts the shots of the shuttle. Since the length of the thread on the tubular cops is known as well as the length of the web lay 1 it can easily be calcuated how many shots are possible at maximum without running out of thread. This maximum number of shots is preset in the counter. With each shot, the counter receives a signal and reduces the stored number by one until zero is reached and initiates the cops exchange.

The above described working process can be controlled by electronic control devices with freely programmable control for the machine drive shaft, the drop box exchange, the hydraulic strike devices, the product withdrawal under tension which is necessary with full width looms producing endless paper machine fabrics. The warp let off and the various time-regulated actuations of the individual parts of the tubular cop exchange device. The control devices are preferably designed so that the individual working steps can be actuated when needed also manually and in a respective time sequence.

The tubular cop exchange device in accordance with the embodiment shown hereinabove, can be modified in correspondence with specific requirements, as long as the tubular cop with a cop end formed for withdrawal and another cop end containing a holding pin is pressed by a pressing plunger into the shuttle so that simultaneously a thread gripper which is lowered together with the cop pressing plunger into the trough chamber of the shuttle inserts the cop thread into a rectilinear thread insertion slot of another shuttle end.

It will be understood that each of the elements described above, or two or more together, may also find a useful application in other types of constructions differing from the types described above.

While the invention has been illustrated and described as embodied in a tubular cop exchange arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a tubular cop exchange arrangement for holding a plurality of tubular cops in a loom with a shuttle, for feeding one of said cops into said shuttle and for removing a remaining portion of said cop from said shuttle, comprising a cop magazine having a cop outlet opening to be located over an open trough chamber of a shuttle of said loom, a cop ejecting device for removing said remaining portion of one of said cops from said shuttle, a cop pressing device for pressing another of said cops from said cop magazine into said trough chamber of said shuttle, a cutting device for separating a weft thread from said remaining portion of said cop and a control device for actuating said devices in a predetermined time, the improvement wherein (a) said cop magazine is formed so as to receive said tubular cops each having a cop body having one cop end which is formed for withdrawal and another cop end provided with an attachment part with a holding pin coaxially extending outwardly beyond said cop body, (b) said shuttle has a clamping device provided near one end of a trough chamber for fixing said holding pin of said tubular cop, said shuttle having a thread inserting slot extending from another end of said trough chamber substantially rectilinearly, said shuttle also having a thread brake;

(c) said cop ejecting device has a cop ejecting plunger which is upwardly extendable in a cop exchange position of said shuttle in a direction toward said holding pin clamped in said clamping device;

(d) said cop pressing device has a cop pressing plunger which is extendable in said cop exchange position of said shuttle downwardly against said tubular cop which is located opposite to said cop outlet opening of said cop magazine for passing said holding pin of said tubular cop into said clamping device of said shuttle, and (e) a thread inserting device which is arranged in said cop exchange position of said shuttle over said thread inserting slot and lowerable simultaneously with said cop pressing plunger, said thread inserting device being provided with at least one thread gripper which feeds another weft thread of said tubular cop from a thread slot of said cop magazine into said thread inserting slot.

2. A tubular cop exchange arrangement as defined in claim 1, wherein said thread brake is arranged in alignment with said thread inserting slot.

3. A tubular cop exchange arrangement as defined in claim 1, wherein said thread gripper is arranged to introduce the thread also into said thread brake of said shuttle.

4. A tubular cop exchange arrangement as defined in claim 1, wherein said thread inserting device is connected with said cop pressing plunger for a joint lowering movement.

5. A tubular cop exchange arrangement as defined in claim 1, wherein said cop magazine is movable between a cop pressing position and a rest position in which it releases a space over said shuttle.

6. A tubular cop exchange arrangement as defined in claim 1, wherein said cutting device is connected with said cop residue discharge device for a joint movement.

7. A tubular cop exchange arrangement as defined in claim 6, wherein said cutting device includes a shear and a pressure medium cylinder-piston unit which actuates said shear.

8. A tubular cop exchange arrangement as defined in claim 1, and further comprising two weft thread grippers arranged stationary for engaging a weft thread which is introduced from said shuttle into a web shed, and a weft thread cutting device for separating the weft thread held in said weft thread grippers.

9. A tubular cop exchange arrangement as defined in claim 8, wherein said weft thread cutting device is formed as a thread sheat which is actuatable by a pushing element, and further comprising an abutment part which is movable between an abutment position and a rest position and actuates said thread shear.

10. A tubular cop exchange arrangement as defined in claim 1, wherein said cop magazine has a plurality of storage shafts which have outlet ends provided with separately actuatable blocking flaps.

11. A tubular cop exchange arrangement as defined in claim 13, wherein said storage shafts of said cop magazine are structured for said cops of different types.

12. A tubular cop exchange arrangement as defined in claim 10, wherein said storage shafts of said cop magazine are of different colors.

13. A tubular cop exchange arrangement as defined in claim 10, wherein said cop pressing device is arranged in said cop magazine between neighboring ones of said storage shafts.

14. A tubular cop exchange arrangement as defined in claim 13, wherein said cop pressing device has a pressing plunger and a pressing chamber located under said pressing plunger and subdivided by said blocking flaps.

15. A tubular cop exchange arrangement as defined in claim 1, wherein said thread inserting device has a first one of said thread grippers which is lowerable into said open trough chamber of said shuttle and a second one of said thread grippers which is displaceable relative to said first thread gripper substantially in a longitudinal direction of said shuttle and lowerable outside a shuttle end and a thread clamping cylinder-piston unit for clamping said other weft thread in said thread insertion slot of said shuttle.

16. A tubular cop exchange arrangement as defined in claim 1, and further comprising a cop residue discharge device provided with a cop residue gripper which is movable between a receiving position for said remaining portion of said cop immediately over said clamping device of said shuttle located in said cop exchange position and a releasing position of said remaining portion of said cop.

17. A tubular cop exchange arrangement as defined in claim 1, wherein said cutting device is insertable in said cop exchange position of said shuttle into said trough chamber between said remaining portion of said cop and said thread inserting slot.

18. A tubular cop exchange device as defined in claim 1 for a full width loom for producing endless paper machine fabrics, the improvement further comprising a plurality of positioning elements for fixing said shuttle in said cop exchange position, said cop magazine, said cop pressing device, said cop ejecting device and said thread inserting device being bringable to said cop exchange position, said positioning elements being adjustable between a blocking position and a releasing position, and a return device for returning said shuttle charged with said tubular cop in said shuttle box.

19. A tubular cop exchange arrangement as defined in claim 18, and further comprising a shuttle striking device arranged for forceless displacement of said shuttle (2) in said cop exchange position.

20. A tubular cop exchange arrangement as defined in claim 32, wherein said positioning elements are formed as positioning levers (15,16) which are upwardly turnable to their blocking position.

21. A tubular cop exchange arrangement as defined in claim 18, wherein said return device includes a return cylinder-piston unit and a return element which is actuable by said return cylinder-piston unit and acts on said shuttle.

22. A tubular cop exchange arrangement as defined in claim 21, wherein said return cylinder-piston unit is connected with said cop magazine for joint movement.

23. A tubular cop exchange arrangement as defined in claim 1, and further comprising a measuring device for a residual quantity of said other weft thread on said tubular cop located in said shuttle for automatic actuation on reaching a predetermined value of said residual quantity for starting a cop exchange process.

* * * * *